US006112142A

United States Patent [19]

Shockley et al.

[11] Patent Number: 6,112,142

[45] Date of Patent: Aug. 29, 2000

[54] POSITIVE SIGNAL COMPARATOR AND METHOD

[75] Inventors: James F. Shockley; Mark E. Kane, both of Orange Park, Fla.

[73] Assignee: Quantum Engineering, Inc., Jacksonville, Fla.

[21] Appl. No.: 09/105,583

[22] Filed: Jun. 26, 1998

[51] Int. Cl.[7] ..... G05D 1/00

[52] U.S. Cl. ..... 701/19; 701/20; 701/1; 701/2; 246/4; 246/6; 246/167 R

[58] Field of Search ..... 701/19, 20, 1, 701/2; 246/4, 6, 167 R

[56] References Cited

U.S. PATENT DOCUMENTS

| | | | |
|---|---|---|---|
| 4,107,253 | 8/1978 | Borg et al. | 246/182 B |
| 5,173,681 | 12/1992 | Schockley et al. | 340/441 |
| 5,459,663 | 10/1995 | Franke | 364/426.05 |
| 5,533,695 | 7/1996 | Heggestad et al. | 246/62 |
| 5,978,718 | 11/1999 | Kull | 701/19 |
| 5,995,881 | 11/1999 | Kull | 701/20 |

*Primary Examiner*—William A. Cuchlinski, Jr.
*Assistant Examiner*—Marthe Y Marc-Coleman
*Attorney, Agent, or Firm*—Arthur G. Yeager

[57] ABSTRACT

A signal comparator receives switch-created signals from two stations manned by an engineer and a trainman in a locomotive and compares the signals for a match. The signals are an implementation and acknowledgement of wayside signals. One station is used to acknowledge a signal and unless a match is determined by the other operator entering the same acknowledgement within a preset time interval the system will automatically stop the train. Alarm functions and speed monitoring functions based on matched station signals are also provided. The system is automatically activated anytime a switch is operated or the speed of the train exceeds 15 mph. Signal matching is also required at period time intervals. If such acknowledgement is not forthcoming, the system assumes crew incapacitation and will automatically stop the train. The system has the capability to require acknowledgement when in proximity of a wayside signal by utilizing global positioning or other navigation system data to determine the location of the train with respect to all wayside signals in the rail system.

30 Claims, 4 Drawing Sheets

POSITIVE SIGNAL COMPARATOR AND METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to wayside signaling and on-board locomotive acknowledgement systems for rail transportation and particularly to engineer and trainman acknowledgement systems.

2. Description of Related Art

A wide variety of wayside signal systems are known to the prior art. The system should require that both the trainman and engineer take positive steps to acknowledge a wayside signal between themselves provides additional assurance that the train operation will be in accordance with the signal. Existing communication systems are deficient in this regard in relying on only one operator being aware of the wayside signal and acting accordingly. In addition, significant portions of railroad are unsignalled (dark territory) and may have temporary speed restrictions, known as "slow orders", in effect from time to time. Existing systems do not make use of modern navigation methods such as GPS or onboard inertial navigation systems to implement and/or enforce slow orders. It is most desirable that speed restrictions both with regard to railcar type and track conditions require actual physical activity in the acknowledgement process with appropriate action (such as automatic stopping of the train) in the event that proper responses are not forthcoming. Improvements are therefore needed to provide for greater safety and train control.

BRIEF SUMMARY OF THE INVENTION

In one aspect of the present invention there is provided a positive signal comparator system operatively connected to the controls of a locomotive for comparing signals from two operators on a train comprising a first and second signal input device. Each device includes a plurality of switches for selectively generating a plurality of respective first and second output signals. A controller means is operatively connected to the first and second signal device and includes signal comparator means responsive to the reception of the output signals for determining if the first and second output signals match. The controller means will provide one or more control output signals in response to the determination to the controls of a locomotive. The controller means further includes a timing circuit means for predetermining the time interval between the reception by the controller means of the first and second output signals or signal entries during which a match should occur. The selective operation of one or more switches by an operator of the first and second device is defined as a respective first and second signal entry and the signal comparator means determines whether the first and second signal entries match. Each device includes alarm means for providing indication that a match has not occurred in a predetermined time interval. The control output signal includes a brake operation signal for operating the brake controls of a locomotive if a match between, the first and second signal entries does not occur within a second predetermined time interval established by the timing means.

Other aspects of the controller are that it receives a location indicating signal from a locomotive position indicating system indicating the location of the locomotive with respect to a wayside signal. In addition, the first and second devices are enabled by the controller means for providing respective first and second output signals when any switch is operated. The controller means also receives a signal from the controls of a locomotive indicating the speed of the locomotive for enabling the first and second stations when the speed of a locomotive exceeds a predetermined speed as established by the controller. Finally, one device has an override switch means for preventing the controller means from providing a control output signal if the first and second output signals do not match as determined by the signal comparator means.

Other aspects of the present invention include a system for controlling the operations of a locomotive which has a speed indicating means comprising signal comparator means for comparing signals from two operators onboard a locomotive, the signal comparator means including a first station and a second station for use by a respective operator. Each station includes a plurality of selectively operable switches for selectively creating a respective first and second output signal, a controller means includes the signal comparator means for receiving the output signals and comparing the first and second output signals and providing control output signals to locomotive controls in response to the comparison of the signals by the signal comparator means. The controller means further includes a timing means for establishing a time interval for the comparison of the first and second output signals by the signal comparator means, the timer interval being the time between the reception of one output signal and another output signal. Each station further includes alarm means for providing alarm indication to the respective operator if a match between the first and second output signals is not made by the signal comparator means during the time interval. The controller means will provide a control output signal for stopping the movement of the locomotive if the first and second output signals do not match as determined by the signal comparator means.

Other aspects of the controller means include the reception of a location signal indicating the position of a locomotive with respect to a known location, the response timing means responsive to the location indicating signal for varying the length of the first and second predetermined time intervals in response to the location of the locomotive. The first and second stations are enabled by the controller means for providing respective first and second output signals when any switch is operated. In addition, controller means enables the first and second stations to provide the first and second output signals when the speed of a locomotive exceeds a predetermined speed as established by the controller. Furthermore, the controller means provides a control output for stopping the movement of the locomotive if the speed of the locomotive exceeds a determined speed limit of the locomotive as established by the controller means after the first and second output signals have been compared by the signal comparator means. The determined speed is established by the controller means in response to the selective operation of the switches on each device. The controller means includes memory means including a plurality of predetermined speed limits for the locomotive, each predetermined speed limit corresponding to a predetermined sequence of operation of the switches on said first and second devices. The controller means provides for continuation of movement of the locomotive if the speed of the locomotive is being reduced at a predetermined rate as established by the controller means.

The controller means includes memory means for storing a plurality of known railroad wayside signals and their location. The controller means further including receiving means for receiving a location signal indicating that the locomotive is approaching a known railroad wayside signal at a known location, with the controller means providing a warning signal when the locomotive is within a predetermined distance from the railroad wayside signal when a location signal is received by the receiving means. The controller means provides a control output signal for stopping the locomotive if the first and second output signals do not match the railroad wayside signal that the locomotive is approaching as determined by the signal comparator means. The controller means also includes program means for periodically providing an alerter output signal to require the creation of the respective first and second output signals by respective operators, the controller means providing a control output signal for stopping the movement of a locomotive if the first and second output signals are not created in response to the alerter signal or the signals created do not match as determined by the controller means.

Further aspects of the present invention include methods of comparing signals selectively generated by the operators of a locomotive and stopping the locomotive if the signal does not match. A time period is predetermined in which the match must occur or braking will occur. The devices are enabled when the speed of the locomotive is above a certain speed and disabled when the speed is below a certain value in order to accommodate low speed railyard switching where the devices are not as important as they are during normal rail operations. The methods also include the ability to override the brake signal. In addition, a proximity warning signal can be generated by the storing of the wayside signals in memory and determining the location of the locomotive.

BRIEF DESCRIPTION OF THE SEVERAL VIEWS OF THE DRAWING

The novel features which are believed to be characteristic of this invention are s et forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Introduction

Figure 1:
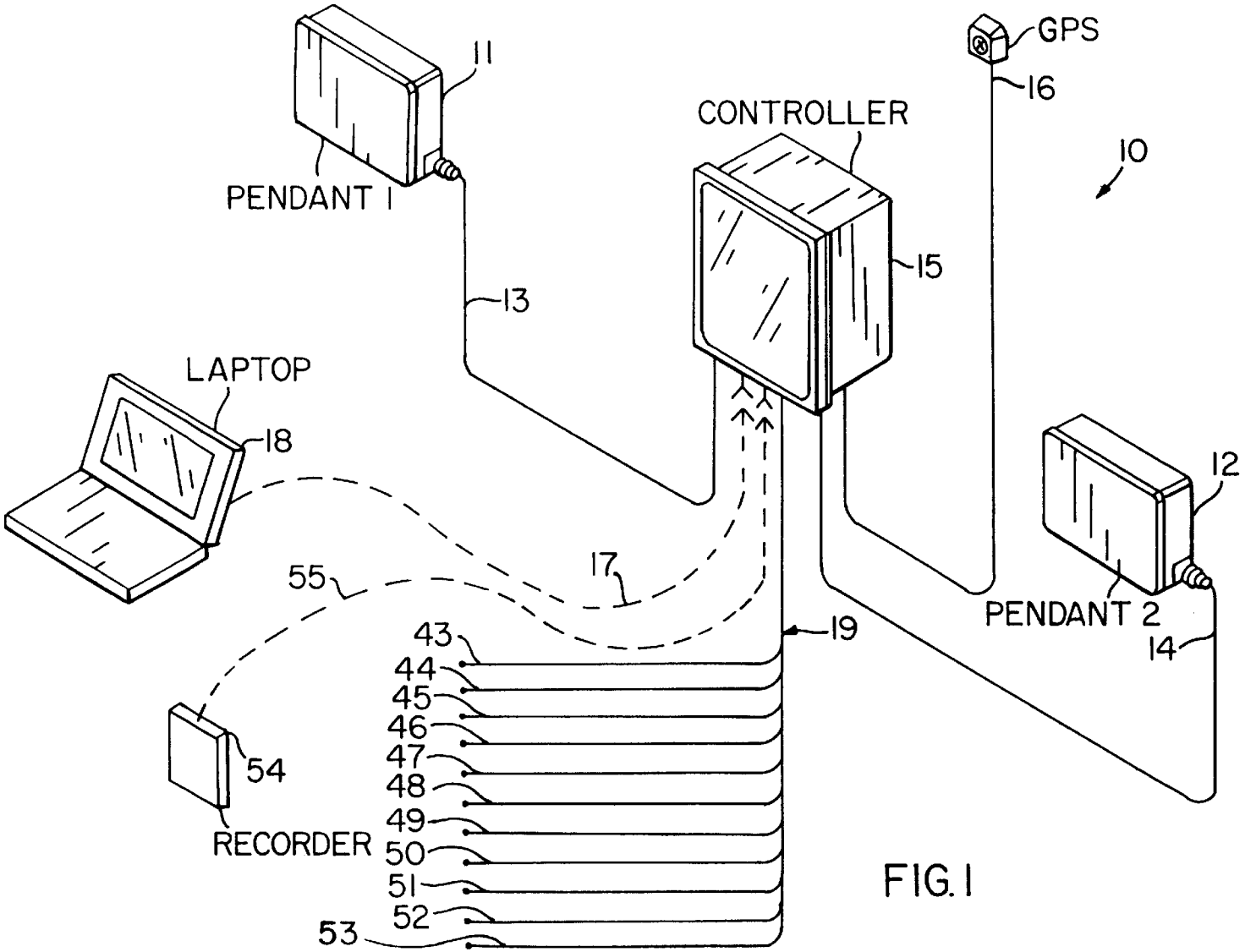
FIG. 1 is a simplified block diagram of the positive signal comparator according to the present invention.

The present invention includes a positive signal comparator (PSC) system to provide that all wayside signal indications visible to the train crew are acknowledged in a manner that requires the trainman and engineer take positive steps to acknowledge the signal and to thus ensure that the train is operated in accord with the signal.

Both the engineer and trainman are provided with a control pendant or box at their respective operating stations. The boxes each contain a display system for visual messages and a series of acknowledgement buttons that provide for two-way communication between the boxes.

Each box includes LED displays. One display will indicate the conditions that the engineer receives and responds to from a wayside signal and that the train should be operated under for a given period prior to the next signal. Another display provides the trainman's response. Accordingly, when the engineer sees a wayside signal he will press the appropriate button which will send a message to the control box of the trainman and be presented on one of the trainman's displays. The trainman will then push the appropriate acknowledgement button. The trainman's response will be displayed to him on one of his displays as well as being sent to the other display of the engineer's box. In this way there is a positive signaling between the engineer and trainman regarding wayside signal indications and therefore the desired operation of the train. Two other displays provide data regarding (1) actual train speed and (2) the maximum speed associated with the acknowledged signal.

Each control pendant also includes a response timing circuit that defines the time available between the engineer's and the trainman's respective responses. If there has not been a positive match between the inputs of the engineer and the trainman within a set time period, various audio and visual alarm functions will be initiated. Furthermore, if a set time period elapses after alarm initiation there still has not been a match between the engineer's and the trainman's response, automatic action to control the train will take place by outputs from the PSC to the train brake system. These automatic actions may include automatic braking and speed monitoring functions.

The engineer is provided with additional controls including an override function. The PSC is also provided with position indicating capability such as that provided by the global positioning system (GPS) or inertial navigation systems. The system also has the capability to provide outputs to optional event recorders in addition to providing event information into its own internal memory.

In summary, the PSC is a time-dependent wayside signal comparator with various inputs and outputs that provide for safe train operation.

The PSC will become "active" anytime (1) any switch button is used or (2) anytime the speed of the locomotive is greater than 15 mph. These features make the system unobtrusive during railyard switching operations. Also, when speed increases above 15 mph the system will require an initial acknowledgement between the engineer and trainman. This feature provides for positive indication that the system is operational and functioning properly. After this initial acknowledgement the PSC will require engineer/trainman acknowledgements at set intervals mandatorily such as one (1) hour between pendant activity as long as the train speed is above 15 mph and no signal button has been depressed in the last hour. In the event that speed is reduced to a "stop" and then increased to greater than 15 mph without any intervening button operation, the PSC will "force" an acknowledgement to further check the system and the crew's actions.

When a wayside signal is encountered the engineer and trainman must acknowledge the signal under which the train is to be operated. The first operator to acknowledge the signal will provide a PSC signal to the other operator to which a response must be sent within a set time interval. If the proper response is given, the response time is set to zero and the audible/visual alarms are extinguished.

Generally speaking, the responses to the wayside signals may involve one to three words which are herein defined as a "signal entry". For example, if the wayside signal is MEDIUM APPROACH MEDIUM (Appendix A), the engineer must depress buttons on his display labeled MEDIUM APPROACH MEDIUM to provide the appropriate signal entry. If the trainman does not respond with the same buttons and in the same order, the response timer which began when the engineer first entered his acknowledgement, will time out and initiate braking of the train. Audio and visual alarms will also be actuated during the timeout of the response timer. After entry completion by either operator, the timing function commences with a single "chirp" of the audible alarm and the response timer is set at a prescribed value and begins counting downward. The prescribed value is based upon a speed variable timing curve (i.e., distance based). After five (5) seconds and as the response timer counts down toward zero as indicated at 22, the number of chirps per second increase, approaching a continuous sounding. This audible alarm condition also is initiated after a one hour period during which no pendant buttons were depressed, and the train speed has continuously exceeded 15 miles per hour during that one-hour period.

The buttons pushed will not require a response unless the sequence matches a known signal entry stored in PSC memory. Thus, the response timer does not become enabled to clock out the time interval until the signal is "loaded and locked"—accepted and displayed on the originating control pendant. Failure to provide the proper response will initiate the alarm functions and ultimately, braking. Once braking is initiated, the train must be brought to a complete stop before the PSC will allow further operation.

Each pendant has two additional active buttons: LAST CAR PAST RESTRICTION and OVERRIDE. The LAST CAR PAST RESTRICTION button provides a signal to allow the speed to be increased to the track speed allowed once the last car of the train is past the restriction.

The PSC displays the last wayside signal agreed to by the engineer and trainman. In certain circumstances for example, a signal such as MEDIUM APPROACH, a medium speed is to be maintained until the last car of the train is clear of the area where the wayside signal controls. Accordingly, the train will be limited to MEDIUM speed until the engineer depresses the LAST CAR PAST RESTRICTION button at which time the train speed may be increased to track speed or maximum authorized speed.

The OVERRIDE button (active only on the engineer's pendant) can be used if the trainman is somehow unavailable, such as being aboard a following second locomotive for various operational checking. The response timer also sets a time interval for the time in which this button can be used. In the preferred embodiment of the present invention, the OVERRIDE function is available only at the engineer's station because operating rules require an operator to be present at the engineer's controls at all times.

The preferred embodiment of the present invention has two further features for use in improving safe train operation:

1. GPS overlay—The PSC system has the capability, via a system antenna, to receive GPS data and combine it with data regarding the location of all wayside signals in the operating territory of the system. With this feature installed, the train crew will receive a "signal proximity warning" when the train is within a predetermined distance of the next wayside signal. The crew must acknowledge the upcoming wayside signal or the PSC system will assume that the crew is incapacitated and automatically bring the train to a complete stop. In addition, inertial navigation systems may be used.
2. Speed enforcement—if the speed of the train exceeds the "target" speed for a given signal by a prescribed speed over the target speed and the train is not decelerating, at a target deceleration amount (e.g., 1 mph/min) PSC alarm functions will be initiated and the response timer will begin clocking out. Automatic braking will occur on timeout of the response timer. This braking will be prevented by either (1) the speed of train being reduced to less than 5 mph above the "target speed"; (2) the train is decelerating at an acceptable rate; or (3) the speed of the train is below the "target speed".

With respect to the drawings, a simplified diagram of the PSC system is shown in FIG. 1 at numeral 10. A first control pendant 11 and second control pendant 12 are connected with wires 13 and 14 to PSC master controller 15 which is mounted to the interior of a locomotive (not shown) by standard means as are pendants 11 and 12. An optional GPS antenna 16 provides an input to PSC controller 15. Output line 17 is a removable connection to external equipment such as a laptop computer 18 for purposes of initialization of the system and diagnostics and other maintenance routines. Other connections identified collectively at numeral 19 will be discussed hereinbelow.

Figure 2:
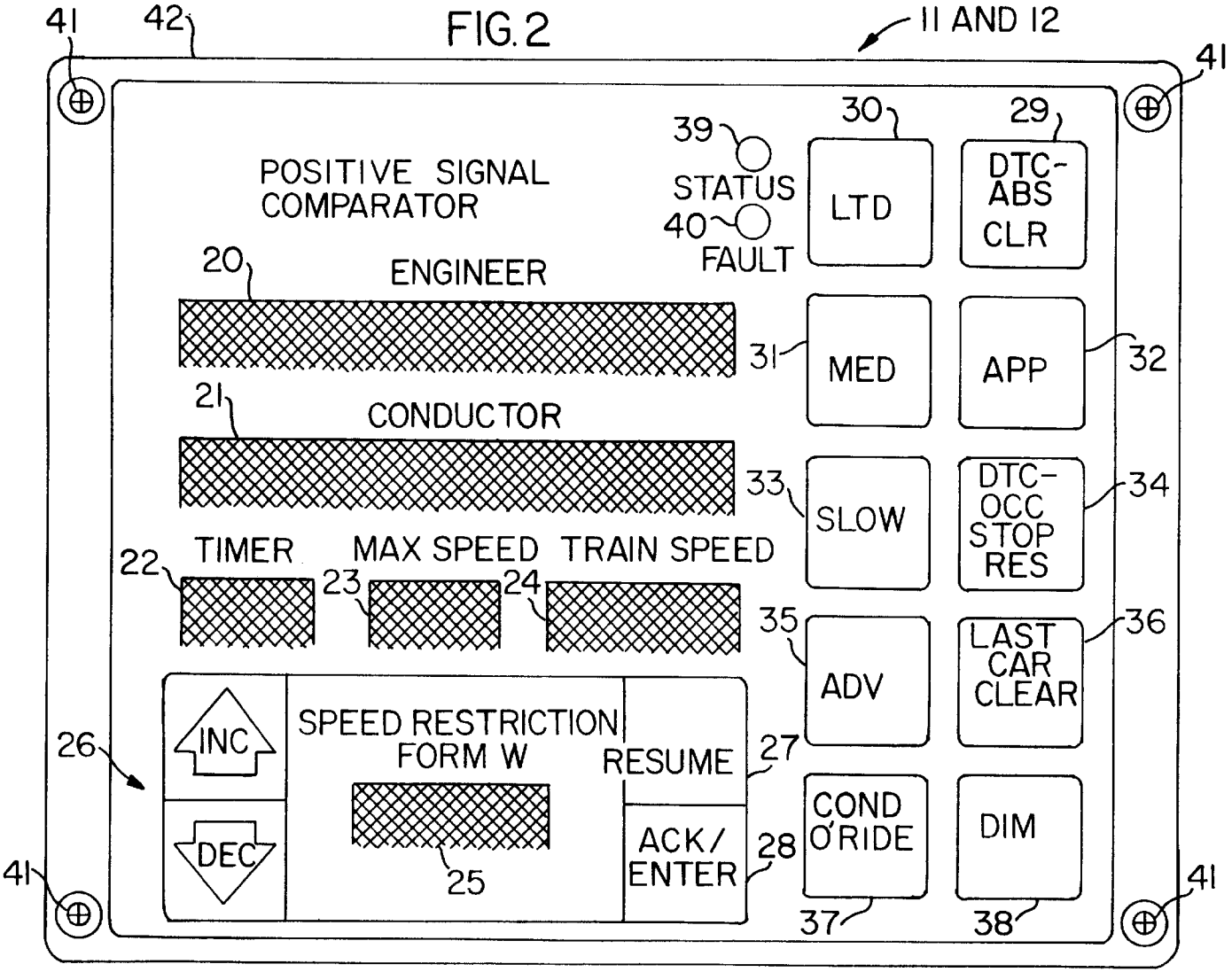
FIG. 2 is a pictorial diagram of a control pendant of FIG. 1.

FIG. 2 illustrates a representative pendant 11 or 12 that are substantially identical. Upper display 20 is for the engineer and lower display 21 is for the trainman/conductor. The displays 20 and 21 are illuminated via inside lights (not shown) for ease of viewing. Below displays 20 and 21 are numerical readouts for the response timer 22, train speed 24, and the maximum speed 23 allowed for the current operating conditions. Below are indicators for speed restriction 25 and increase/decrease button 26. RESUME button 26 and ACK/ENTER button 28 are next to indicator 25.

The array of operating buttons is to the right:

1. CLEAR 29
2. LIMITED 30
3. MEDIUM 31
4. APPROACH 32
5. SLOW 33
6. STOP/RESTRICTED 34
7. ADVANCE 35

Also included without indicators are:

8. LAST CAR PAST RESTRICTION 36
9. OVERRIDE 37
10. DIM 38 (for displays 20–25)

The meaning of the various wayside signals and the associated indications is shown in Appendix A.

Buttons 29 and 34 are also used in DTC or Direct Traffic Control territory. This is a type of train operation in territories where electronic signals (visual signals) do not exist. This is sometimes referred to as "dark territory". Dispatchers give trains authority to operate within certain limits (mileposts) over a specified period of time. The authorities given are of two types. Either the dispatcher will give an absolute clear, indicating no other train traffic will be encountered, or a restrictive clear indicating the train may proceed, but must be prepared to stop upon visual sighting of additional traffic. In these two cases, the train crew will use the DTC-ABS button 29 to indicate "Direct Traffic Control-Absolute Clear". Or the DTC-OCC STOP CLEAR button 34 to indicate Direct Traffic Control-other traffic occupying the track, speed is restricted to such that train can stop within sight distance.

Indicator 39 for GPS status is included above system fault indicator 40. All of the electronics are included in a respective housing 42 held together via screws 41.

Wire bundle 19 includes connections as follows:

1. Battery positive 43 and negative 44
2. Axle drives 45 and 46 (electric power)
3. Locomotive alerter 47 (optional equipment input)
4. Direction indicating reverse 48, forward 49
5. Two types of axle drives 50 (selectable input)
6. External cutout 51
7. Magnetic air valve input 52 and output 53.

In order to insure that the system 10 has updated signal and "slow order" or speed restriction information for the territory to be traversed by the train several updating options are available in the preferred embodiment of the system:

A. Operator Update

The train crew must "sign up" before boarding the train. The operator can be given a credit card-sized memory device or some similar device having the latest track information at the "sign up" location. After receiving this data, a crewman can board the train and read this latest data into the system 10.

B. Radio Update

At prescribed railroad locations, a low power transmitter can be employed to automatically update the system 10. Additionally, the existing RF infrastructure of the rail system could be employed to update all locomotives with new data.

C. Computer Update

During mechanical inspections the laptop 18 or other memory device could be used to update the system database. Because the PSC system 10 displays the date the system was last updated the crew can verify that they have the latest data.

Figure 3:
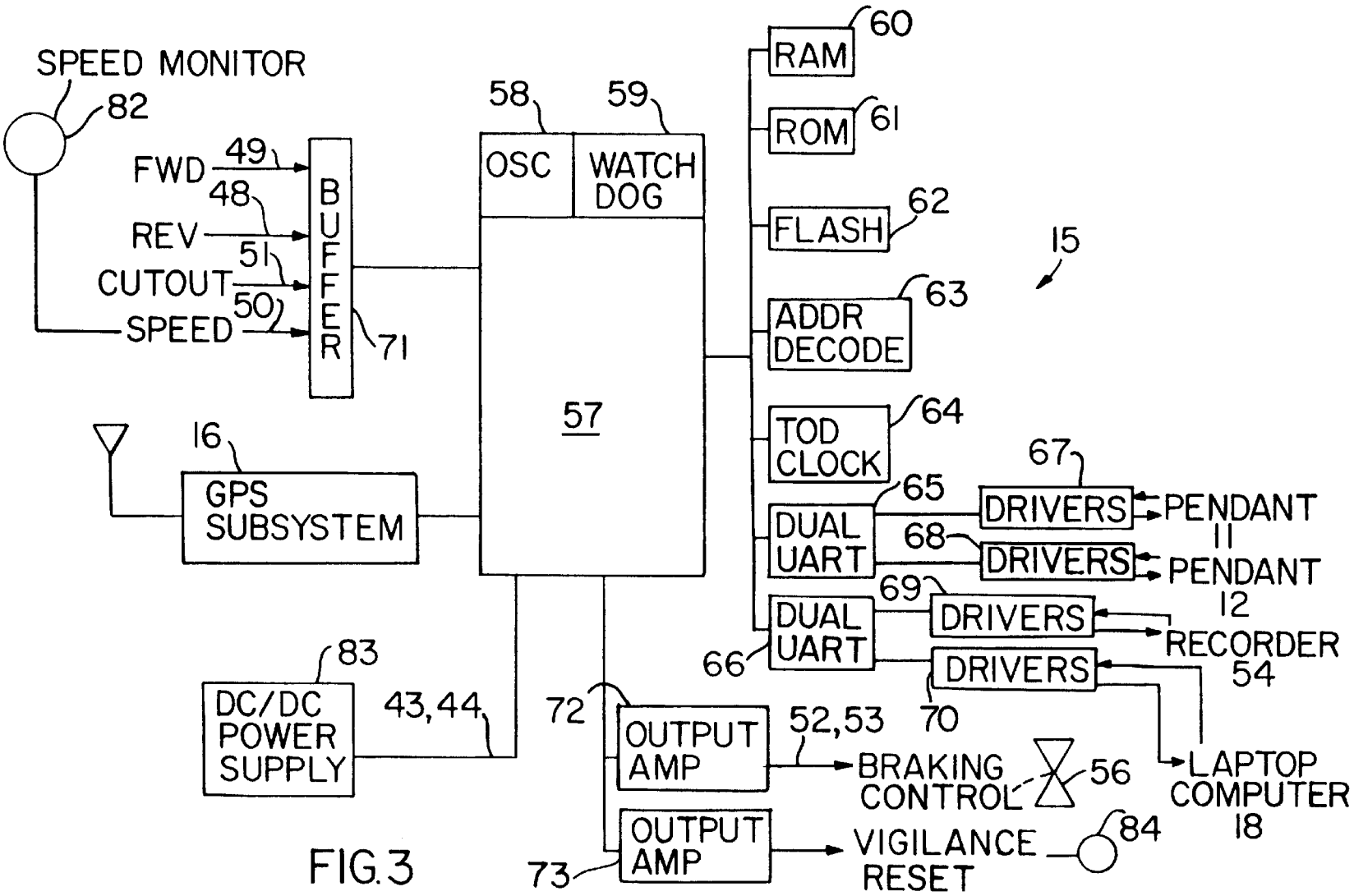
FIG. 3 is a block diagram of the master controller of FIG. 1.

FIG. 3 is a simplified block diagram of the PSC master controller 15. Microprocessor 57 includes clock oscillator 58 and watch dog timer 59 which is a conventional fault monitor as understood in the art. RAM 60, ROM 61, flash memory 62, address decoder 63, time-of-day clock 64 and dual UARTS 65 and 66 are all conventional circuits known in the art. Drivers 67–70 are used for input and output to pendants 11 and 12, optional event recorder 54 and laptop computer 18. Buffer 71 provides for interfacing for reverse 48 and forward 49 direction indicators (used with GPS 16 inputs) external cutout switch 51 and speed indication signal at 50. Speed monitor 82 and DC/DC power supply 83 connected to the locomotive electrical system (not shown) are also standard. Output amplifier 73 provides a control signal to magnetic brake valve 56 for train brake operation and control. Output amplifier 73 provides a signal, "Vigilance Reset", to device 84, an alerter system related to the well-known "Dead Man's Control".

Figure 4:
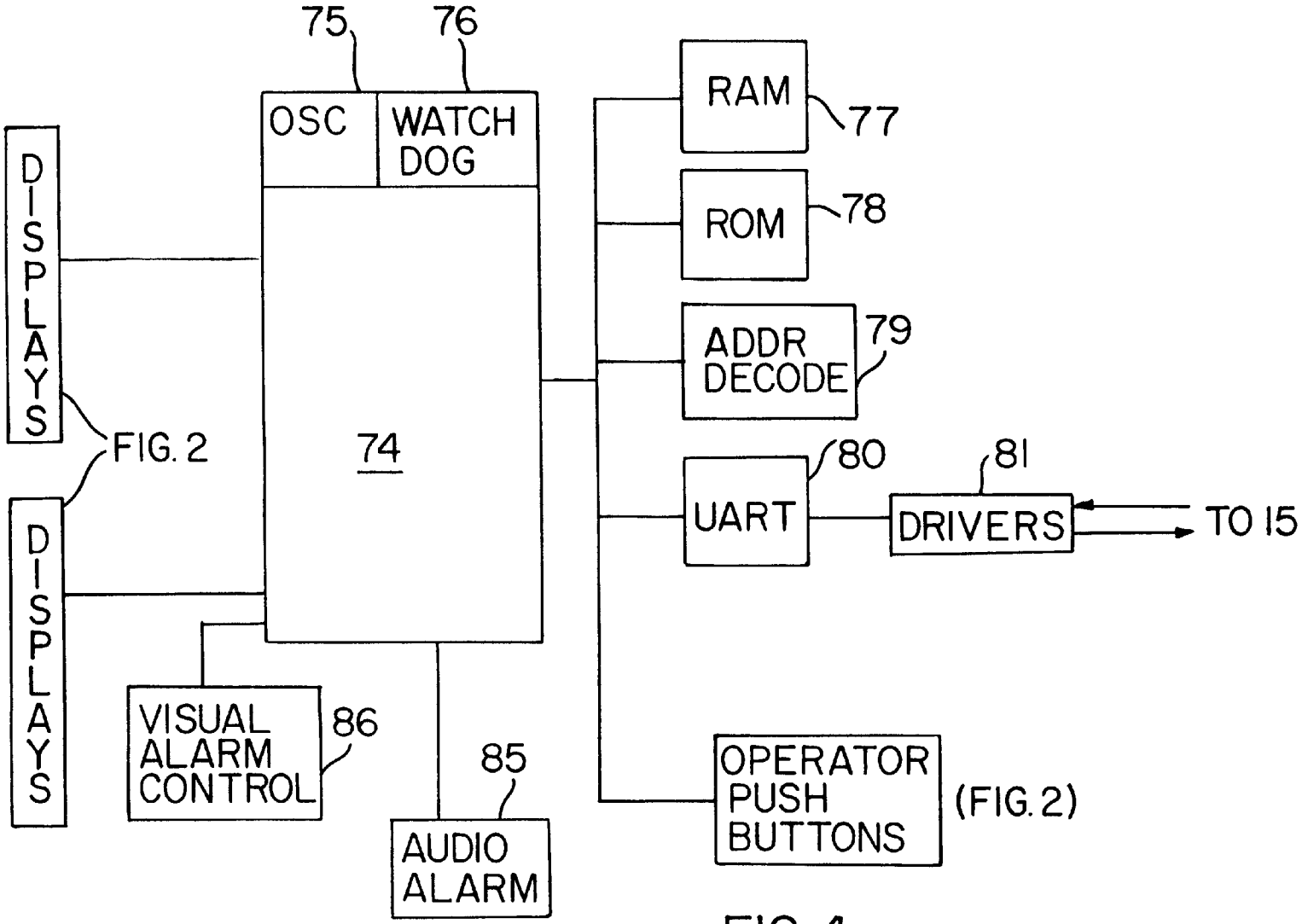
FIG. 4 is a block diagram of a control pendant of FIGS. 1 and 2.

FIG. 4 illustrates a simplified block diagram of a pendant 11 or 12. A conventional microprocessor 74 has oscillator 75 and watch dog timer 76. RAM 77, ROM 78, address decoder 79, UART 80 and input/output driver 81 are all standard as understood in the art. Visual alarm control 86 flashes the appropriate display 20 or 21. Audio alarm provides a "chirping" sound as an audible alarm signal. The displays and operator push buttons are shown in more detail in FIG. 2. Event recorder 54 is a remote device. Alternatively, the port for the recorder can be used for remote terminal inputs if so desired. With respect to FIG. 2, the speed restriction section of a pendant 11 and 12 will be discussed. The system is designed to allow the conductor to "set up" a speed restriction at any time. It will also allow the engineer to "acknowledge" it when the engine gets to the point of the restriction. Allowable speeds to be set into the system are (in order): 707-5-10-15-20-25-30-35-40-45-49-50-55-60-65-70-75-79. The 707 is a CSX rule number, and requires operators await a flagman for movement authority. The process is as follows:

1. The conductor determines that the engine will be approaching a speed restriction. He then presses the INC or DEC buttons 26 until the desired speed is displayed on the conductor's "Speed Restriction" LED display 25. When correct, he then pushes the ACK/ENTER button 28. The speed is then copied to the Engineer's "speed restriction" display 25 and the box chirps once via audio alarm 85. The "speed restriction" display 25 is to flash via visual alarm circuit 86, alerting the engineer that a restriction is pending. The engineer sees the restriction in his "speed restriction" display 25. No further action is needed at that time.
2. When the engineer approaches the location of the speed restriction, he presses the ACK/ENTER button 28 and the box chirps once. The "speed restriction" display 25 changes from flashing to solid, indicating to the engineer that the speed restriction is in force. The speed restriction will now be enforced by PSC 15, including the process of initiating overspeed penalties.
3. When the train is past the restriction and no other restrictions are in place, the RESUME button 27 is pushed, and the "speed restriction" display is cleared. If another restriction were encountered, the above steps would be repeated. Either the engineer or conductor may use the RESUME button 27.

Importantly unlike the signal aspect data entry described herein above, this process must always be Conductor first, Engineer second. If the Conductor Override mode is ON (via button 37), no action is required of the Engineer.

The PSC 15 will have a selectable Maximum Authorized Speed for each train—e.g., if the train has an empty car, the box should be programmed that the trains's max speed is 50 MPH, regardless of signal aspects encountered throughout the trip. This is to be accomplished by pressing and holding the ACK/ENTER button 28 for 3 seconds. At this point display 21 will show "ENTER MAX SPEED". The INC and DEC buttons 26 are to be used to select the MAX speed of the train. When selected, a second push of the ACK/ENTER button 28 will store the value in memory, and display in the MAX SPEED display.

The speed restrictions selected above cannot be greater than the MAX speed selected. For example, if a train is limited to 40 MPH due to equipment type, a 50 MPH speed restriction on a curve is irrelevant. Likewise, a signal aspect that requires a train to reduce to limited speed would have the MAX speed set to 40 MPH, not 45 MPH.

The overspeed limits when employing the speed restriction are as follows:

| Speed Restriction (MPH) | Overspeed Limit (MPH) |
|---|---|
| 05 | 06 |
| 10 | 11 |
| 15 | 16 |

-continued

| Speed Restriction (MPH) | Overspeed Limit (MPH) |
|---|---|
| 20 | 25 |
| 25 | 30 |
| 35 | 40 |
| Etc. | |

The wayside signal response is found in the three sheets of Tables found in Appendix A attached hereto.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A positive signal comparator system operatively connected to the controls of a locomotive for comparing signals from two operators on a train comprising a first and second signal input device, each said device including a plurality of switches for selectively generating a plurality of respective first and second output signals, controller means operatively connected to said first and second signal device, said controller means including signal comparator means responsive to the reception of said output signals for determining if said first and second output signals match, said controller means providing one or more control output signals in response to said determination to the controls of a locomotive.

2. The system as defined in claim 1 wherein said controller means further includes a timing circuit means for predetermining the time interval between the reception by said controller means of said first and second output signals during which a match should occur.

3. The system as defined in claim 1 wherein the selective operation of one or more switches by an operator of said first and second device in defined as a respective first and second signal entry, said signal comparator means determining whether said first and second signal entries match.

4. The system as defined in claim 3 wherein said controller means includes a response timing means for providing a first predetermined time interval for the determining a match between said first and second signal entries.

5. The system as defined in claim 4 wherein each said device includes alarm means for providing indication that a match has not occurred in said first predetermined time interval.

6. The system as defined in claim 5 wherein said control output signal includes a brake operation signal for operating the brake controls of a locomotive if a match between said first and second signal entries does not occur within a second predetermined time interval established by said response timing means.

7. The system as defined in claim 1 wherein said controller receives a location indicating signal from a locomotive position indicating system indicating the location of the locomotive with respect to a wayside signal.

8. The system as defined in claim 1 wherein said first and second devices are enabled by said controller means for providing respective first and second output signals when any said switch is operated.

9. The system as defined in claim 8 wherein said controller means receives a signal from the controls of a locomotive indicating the speed of the locomotive, said controller means enabling said first and second stations for providing said first and second output signals when the speed of a locomotive exceeds a predetermined speed as established by said controller.

10. The system as defined in claim 1 wherein one said device has an override switch means for preventing said controller means from providing a said control output signal if said first and second output signals do not match as determined by said signal comparator means.

11. A system for controlling the operations of a locomotive which has a speed indicating means comprising signal comparator means for comparing signals from two operators onboard a locomotive, said signal comparator means including a first station and a second station for use by a respective operator, each said station including a plurality of selectively operable switches for selectively creating a respective first and second output signal, controller means including signal comparator means for receiving said output signals and comparing said first and second output signals and providing control output signals to the controls of a locomotive in response to the comparison of said first and second output signals by said signal comparator means.

12. The system as defined in claim 11 wherein said controller means further includes a timing means for establishing a time interval for the comparison of said first and second output signals by said signal comparator means, said time interval being the time between the reception of one said output signal and another said output signal.

13. The system as defined in claim 12 wherein each said station further includes alarm means for providing alarm indication to the respective operator if a match between said first and second output signals is not made by said signal comparator means during said time interval.

14. The system as defined in claim 11 wherein said controller means provides a said control output signal for stopping the movement of the locomotive if said first and second output signals do not match as determined by said signal comparator means.

15. The system as defined in claim 11 wherein said controller means receives a location signal indicating the position of a locomotive with respect to a known location, said response timing means responsive to said location indicating signal for varying the length of said first and second predetermined time intervals in response to the location of the locomotive.

16. The system as defined in claim 11 wherein said first and second stations are enabled by said controller means for providing respective first and second output signals when any said switch is operated.

17. The system as defined in claim 11 wherein said controller means enabling said first and second stations to provide said first and second output signals when the speed of a locomotive exceeds a predetermined speed as established by said controller.

18. The system as defined in claim 11 wherein said controller means provides a said control output for stopping the movement of the locomotive if the speed of the locomotive exceeds a determined speed limit of the locomotive as established by said controller means after said first and second output signals have been compared by said signal comparator means.

19. The system as defined in claim 18 wherein said determined speed is established by said controller means in response to the selective operation of said switches on each said device.

20. The system as defined in claim 19 wherein said controller means includes memory means, said memory means including a plurality of predetermined speed limits for the locomotive, each said predetermined speed limit corresponding to a predetermined sequence of operation of said switches on said first and second devices.

21. The system as defined in claim 18 wherein said controller means provides for continuation of movement of the locomotive if the speed of the locomotive is being reduced at a predetermined rate as established by said controller means.

22. The system as defined in claim 11 wherein said controller means includes memory means for storing a plurality of known railroad wayside signals and their location, said controller means further including receiving means for receiving a location signal indicating that the locomotive is approaching a known railroad wayside signal at a known location, said controller means providing a warning signal when the locomotive is within a predetermined distance from the railroad wayside signal when a said location signal is received by said receiving means, said controller means providing a said control output signal for stopping the locomotive if said first and second output signals do not match the railroad wayside signal that the locomotive is approaching as determined by said signal comparator means.

23. The system as defined in claim 11 wherein said controller means includes program means for periodically providing an alerter output signal to require the creation of said respective first and second output signals by respective operators, said controller means providing a said control output signal for stopping the movement of a locomotive if said first and second output signals are not created in response to said alerter signal or said signals created do not match as determined by said controller means.

24. A method of controlling the operation of a locomotive on a railroad having a brake control system for stopping the movement of a locomotive comprising the steps of:

A. selectively creating a pair of output signals by two respective operators in a locomotive by selective operation of switches located on a pair of distinct devices located in the locomotive;

B. comparing the output signals from the devices to determine a match or mismatch; and C. generating a brake signal to the brake control system of the locomotive if the output signals do not match in step B.

25. The method of claim 24 wherein step C includes the step of:

D. establishing a predetermined time period during which a match must occur.

26. The method of claim 24 further including the steps of:

D. determining the speed of the locomotive; and

E. enabling the devices to provide output signals when the speed of the locomotive is greater than a predetermined speed.

27. The method of claim 24 further including the step of:

D. selectively overriding the brake signal to the brake control system in step C by an operator of one of the devices.

28. The method of claim 24 further including the steps of:

D. storing in a memory a plurality of railroad wayside signals and their location;

E. determining the location of the locomotive with respect to a wayside signal stored in step D; and F. providing a warning signal to at least one of the operators of a locomotive when the locomotive is within a predetermined distance of a wayside signal.

29. The method of claim 28 further including the step of:

G. generating the brake signal of the switches of the pair of devices are not operated in a predetermined manner.

30. The method of claim 28 further including the steps of:

G. determining if switches on each device have been selectively operated to generate an output signal corresponding to the wayside signal of step F; and H. generating the brake signal to stop the locomotive if the output signals do not correspond to the wayside signal as determined in step G.

* * * * *